US006191330B1

(12) United States Patent
Matsuno et al.

(10) Patent No.: US 6,191,330 B1
(45) Date of Patent: Feb. 20, 2001

(54) TRACTION DRIVE FLUID

(75) Inventors: Mitsuo Matsuno; Shinichi Shirahama; Tetsuo Okawa, all of Yokohama; Takashi Kiyota, Tokyo, all of (JP)

(73) Assignees: Nippon Mitsubishi Oil Corporation; San-Petrochemical Co., Ltd., both of Tokyo (JP)

( * ) Notice: Under 35 U.S.C. 154(b), the term of this patent shall be extended for 0 days.

(21) Appl. No.: 09/398,923

(22) Filed: Sep. 16, 1999

(30) Foreign Application Priority Data

Sep. 18, 1998 (JP) ..... 10-264500

(51) Int. Cl.[7] ..... C07C 13/28; C10M 105/02

(52) U.S. Cl. ..... 585/21; 585/20; 585/22; 508/110; 508/591; 252/73

(58) Field of Search ..... 585/20, 21

(56) References Cited

U.S. PATENT DOCUMENTS

| | | | | |
|---|---|---|---|---|
| 4,521,324 | * | 6/1985 | Tsubouchi et al. | 252/83 |
| 4,556,503 | * | 12/1985 | Tsubouchi et al. | 252/73 |
| 4,604,490 | * | 8/1986 | Yuasa et al. | 585/21 |
| 4,609,481 | * | 9/1986 | Tsubouchi et al. | 252/73 |
| 4,675,459 | * | 6/1987 | Yuasa et al. | 585/21 |
| 4,804,795 | * | 2/1989 | Yuasa et al. | 585/21 |
| 4,975,215 | * | 12/1990 | Abe et al. | 252/73 |
| 5,126,065 | * | 6/1992 | Tsubouchi et al. | 585/20 |
| 5,306,851 | * | 4/1994 | Wu et al. | 585/22 |
| 5,344,582 | * | 9/1994 | Umemoto et al. | 252/73 |

FOREIGN PATENT DOCUMENTS

| | | |
|---|---|---|
| 1-197594 | 8/1989 | (JP) . |
| 7-242891 | 9/1995 | (JP) . |

* cited by examiner

*Primary Examiner*—Ellen M. McAvoy
(74) *Attorney, Agent, or Firm*—Akin, Gump, Strauss, Hauer & Feld, L.L.P.

(57) ABSTRACT

Disclosed is a traction drive fluid which comprises (A) one or more than two compounds selected from the group consisting of saturated polycyclic hydrocarbon compounds represented by the formulae:

(1)

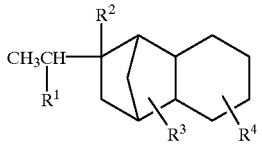

wherein $R^1$ and $R^2$ are each independently hydrogen or a methyl group, provided that the case where both $R^1$ and $R^2$ are a methyl group at the same time is excluded, and $R^3$ and $R^4$ are each independently hydrogen or a methyl group;

(2)

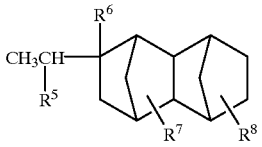

wherein $R^5$ and $R^6$ are each independently hydrogen or a methyl group, provided that the case where both $R^5$ and $R^6$ are a methyl group at the same time is excluded, $R^7$ and $R^8$ are each independently hydrogen or a methyl group; and (3)

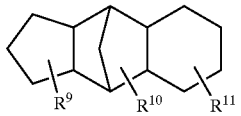

wherein $R^9$, $R^{10}$ and $R^{11}$ are each independently hydrogen or a methyl group.

18 Claims, No Drawings

TRACTION DRIVE FLUID

BACKGROUND OF THE INVENTION

1. Field of the Invention

This invention relates to fluids for traction drives, and more particularly to such traction drive fluids which can be used not only for the driving force transmitting mechanism but also for the hydraulic pressure controlling mechanism and the friction characteristics controlling mechanism of the wet clutch, of the continuously variable transmissions of traction drive type of automobiles.

2. Description of Prior Art

In the field of industrial machines, traction drive fluids have already been used in traction drive type power transmitting apparatuses which transmit power via the film of the traction drive fluids. Such traction drive fluids are required to be high in traction coefficient which indicates power transmission capability.

In recent years, extensive studies and investigations on a traction drive fluid have progressed for its use of continuously variable transmissions of automobiles. The traction drive fluids to be used for an automobile are expected to be used not only in the power transmitting mechanism but also in the hydraulic controlling mechanism and the friction characteristics controlling mechanism for the wet clutch thereof.

Automatic transmission fluid (ATF) is known as a lubricant used for the hydraulic controlling mechanism of the transmission of an automobile and the friction characteristics controlling mechanism of the wet clutch of the same. It is a well-known fact that such ATF is required to be higher in a kinematic viscosity at elevated temperatures than a certain level and superior in flowability at low temperatures for performing the role of the hydraulic controlling mechanism. It is also well known that ATF needs to be blended with additives which are excelled in friction characteristics, particularly in anti-shudder characteristics for fulfilling requirements in performing the role of the friction characteristics controlling mechanism, particularly the controlling mechanism having in addition slip controlling capabilities.

SANTOTRAC is a commercially available traction drive fluid and widely known to have an excellent power transmitting capability. Traction drive fluids to be used for automobile continuously variable transmissions are required to fulfill requirements in flowability at low temperatures and other performances, but such traction drive fluids have not been placed on the market yet.

SUMMARY OF THE INVENTION

The object of the present invention is to provide a traction drive fluid which is superior not only in power transmitting capability but also has capabilities required as a fluid for a hydraulic controlling mechanism, i.e., flowability at low temperatures and capabilities required as a fluid for a wet type friction material controlling mechanism.

Therefore, the present invention seeks to provide a traction drive fluid particularly suitable for a continuously variable transmission of traction drive type which can be used for the power transmitting mechanism and also applicable to the hydraulic controlling mechanism and friction characteristics controlling mechanism of the transmission.

According to one embodiment of the invention, there is provided a traction drive fluid which comprises (A) one or more than two compounds selected from the group consisting of saturated polycyclic hydrocarbon compounds represented by the formulae (1)

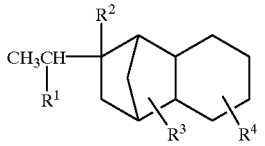

wherein $R^1$ and $R^2$ are each independently hydrogen or a methyl group, provided that the case where $R^1$ and $R^2$ are a methyl group at the same time is excluded, and $R^3$ and $R^4$ are each independently hydrogen or a methyl group;

(2)

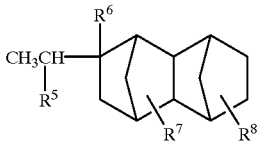

wherein $R^5$ and $R^6$ are each independently hydrogen or a methyl group, provided that the case where $R^5$ and $R^6$ are a methyl group at the same time is excluded, and $R^7$ and $R^8$ are each independently hydrogen or a methyl group; and (3)

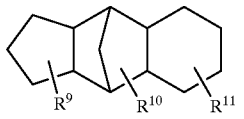

wherein $R^9$, $R^{10}$ and $R^{11}$ are each independently hydrogen or a methyl group.

According to another embodiment of the present invention, there is provided a traction drive fluid which comprises (A) the aforesaid polycyclic hydrocarbon compounds of formulae (1)–(3) and one or more than two compounds selected from the group consisting of polycyclic hydrocarbon compounds represented by the formula (4)

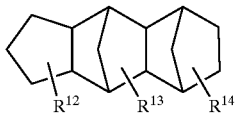

wherein $R^{12}$, $R^{13}$ and $R^{14}$ are each independently hydrogen or a methyl group.

According to further embodiment of the present invention, there is provided a traction drive fluid which comprises (A) the aforesaid polycyclic hydrocarbon compounds of formulae (1)–(3), (B) the aforesaid polycyclic hydrocarbon compounds of formula (4) and (C) at least one member selected from the group consisting of a mineral oil and a synthetic oil having an molecular weight of 150–800.

The traction drive fluid according to the present invention is preferably blended with (D) a viscosity index improver. Preferred viscosity index improvers are ethylene-α-olefin copolymers having a number average molecular weight of 800–150,000 or hydrogenated products thereof.

Alternatively, the traction drive fluid of the present invention is preferably blended with (E) an ashless dispersant and (F) a phosphorus-containing additive.

Further alternatively, the traction drive fluid of the present invention is preferably blended with (G) a friction modifier having in its molecules at least one $C_6$–$C_{30}$ alkyl or alkenyl group and no hydrocarbon groups of more than 31 carbon atoms.

Further alternatively, the traction drive fluid of the present invention is preferably blended with (H) a metal-containing detergent having a total base number of 20–450 mgKOH/g.

DETAILED DESCRIPTION OF THE INVENTION

The traction drive fluid of the present invention comprises (A) one or more than two compounds selected from the group consisting of saturated polycyclic hydrocarbon compounds represented by the formulae (1)

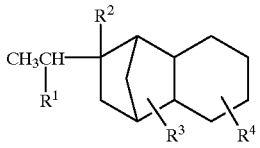

wherein $R^1$ and $R^2$ are each independently hydrogen or a methyl group, provided that the case where $R^1$ and $R^2$ are a methyl group at the same time is excluded, and $R^3$ and $R^4$ are each independently hydrogen or a methyl group;

(2)

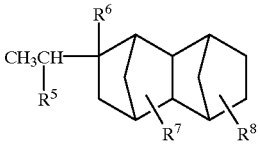

wherein $R^5$ and $R^6$ are each independently hydrogen or a methyl group, provided that the case where $R^5$ and $R^6$ are a methyl group at the same time is excluded, and $R^7$ and $R^8$ are each independently hydrogen or a methyl group; and (3)

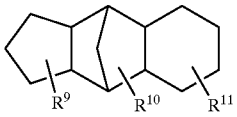

wherein $R^9$, $R^{10}$ and $R^{11}$ are each independently hydrogen or a methyl group.

Alternatively, the inventive traction drive fluid may further contains (B) one or more than two compounds selected from the group consisting of polycyclic hydrocarbon compounds of the formula (4)

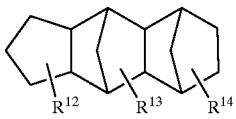

wherein $R^{12}$, $R^{13}$ and $R^{14}$ are each independently hydrogen or a methyl group.

The saturated polycyclic hydrocarbon compounds of formulae (1)–(3) can be produced by various methods. In general, the saturated polycyclic hydrocarbon compounds may be produced by synthesizing unsaturated polycyclic hydrocarbons by Diels-Alder reaction and subsequently hydrogenating the unsaturated polycyclic hydrocarbons, as specifically described below.

The Diels-Alder reaction of butadiene and/or isoprene with cyclopentadiene and/or methylcyclopentadiene proceeds to give norbornene compounds of formula (5), as shown in the following formula [I];

[I]

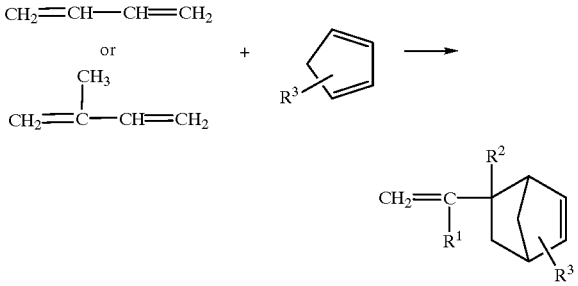

(5)

wherein $R^1$ and $R^2$ are each independently hydrogen or a methyl group, provided that the case where $R^1$ and $R^2$ are a methyl group at the same time is excluded, and $R^3$ is hydrogen or a methyl group.

Further Diels-Alder reaction of the norbornene compounds of formula (5) with butadiene or isoprene proceeds as shown in the following formula [II] thereby obtaining a 1:1 adduct of formula (6) of the norbornene compounds and butadiene and/or isoprene;

[II]

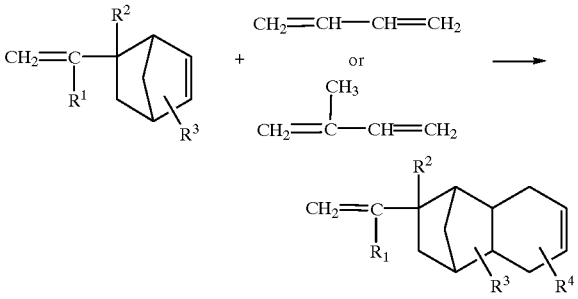

(6)

wherein $R^1$ and $R^2$ are each independently hydrogen or a methyl group, provided that the case where $R^1$ and $R^2$ are a methyl group at the same time is excluded, and $R^3$ and $R^4$ are each independently hydrogen or a methyl group.

When the norbornene compounds are subjected to Diels-Alder reaction with cyclopentadiene and/or methylcyclopentadiene, the reaction proceeds as shown in formula [III] thereby giving a 1:1 adduct of formula (7) of the norbornene compounds and cyclopentadiene and/or methylcyclopentadiene;

[III]

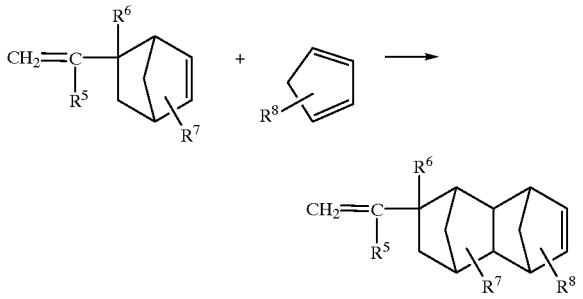

(7)

wherein $R^5$ and $R^6$ are each independently hydrogen or a methyl group, provided that the case where $R^5$ and $R^6$ are a methyl group at the same time is excluded, and $R^7$ and $R^8$ are each independently hydrogen or a methyl group.

Diels-Alder reaction of cyclopentadiene and/or methylcyclopentadiene proceeds as shown in formula [IV] thereby giving a dimer of formula (8);

[IV]

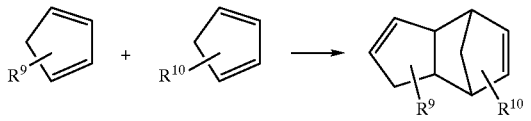

(8)

wherein $R^9$ and $R^{10}$ are each independently hydrogen or a methyl group.

Diels-Alder reaction of the dimer of formula (8) and butadiene and/or isoprene proceeds as shown in formula [V] thereby giving a 1:1 adduct of formula (9) of the dimer and butadiene and/or isoprene;

[V]

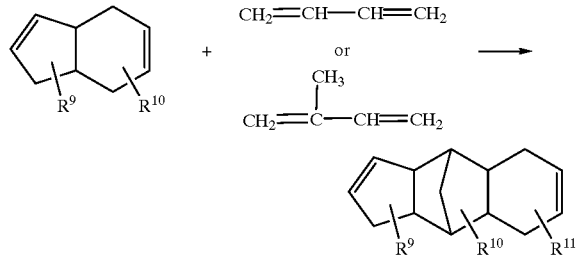

(9)

wherein $R^9$, $R^{10}$ and $R^{11}$ are each independently hydrogen or a methyl group.

Diels-Alder reaction of the dimer with cyclopentadiene and/or methylcyclopentadiene proceeds as shown in formula [VI] thereby giving trimers of formula (10);

[VI]

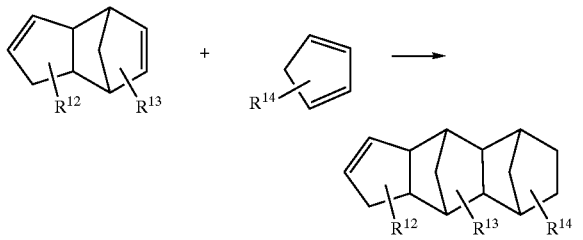

(10)

wherein $R^{12}$, $R^{13}$ and $R^{14}$ are each independently hydrogen or a methyl group.

The aforesaid Diels-Alder reactions are thermal reactions which; therefore, do not require any catalyst.

Cyclopentadiene and/or methylcyclopentadiene used in the Diels-Alder reactions may be added in the form of a monomer to the reaction mixture. Alternatively, dicyclopentadiene, methyldicyclopentadiene and methylcyclopentadiene dimers which are easily available and thermally decompose under the reaction conditions to produce cyclopentadiene and/or methylcyclopentadiene may be used as the starting material.

The molar ratio of the diene to the dienophile is from 1:200 to 1:0.1, preferably 1:100 to 1:0.2.

The reaction temperature of the Diels-Alder reactions is generally 50–250° C., preferably 80–200° C.

Though the reaction time may vary depending on the reaction temperature, it may be from 10 minutes to 40 hours, preferably from 30 minutes to 30 hours.

In these Diels-Alder reactions, polymerization inhibitors such as hydroquinone, p-phenylenediamine and t-butylcatechol may be added in order to inhibit the formation of polymers. These reactions may be conducted in solvents which does not hinder the reaction, such as lower alcohols which may be methanol or ethanol, and hydrocarbons which may be toluene and cyclohexane. These Diels-Alder reactions may be conducted batchwise, semibatchwise or continuous methods.

After the reaction, the desired product of formula (6), (7), (9) or (10) can be obtained by subjecting the reaction product to a separation and purification process such as distillation and chromatographical-separation.

The reaction products of formula (6), (7), (9) or (10) which have been synthesized and purified are hydrogenated so as to saturate the double bond thereof, thereby obtaining the saturated polycyclic hydrocarbon compounds of formula (1), (2), (3) or (4).

The hydrogenation reaction can be carried out under the same conditions as in the ordinary hydrogenation of unsaturated hydrocarbons.

The hydrogenation can be easily conducted at a temperature of 20–225° C. and a hydrogen pressure of 0.1 to 20 MPa using a hydrogenation catalyst which may be a noble metal such as platinum, palladium, rhodium and ruthenium, Raney nickel and nickel diatomaceous earth.

This hydrogenation may be conducted in the absence of a solvent, but may be carried out in a solvent such as hydrocarbons, alcohols, ethers and esters.

After the hydrogenation, the solvent, the catalyst residue, the unreacted product and the by-product are removed by such operation as filtration, distillation and chromatographical-separation, thereby obtaining the saturated polycyclic hydrocarbon compounds of formula (1), (2), (3) or (4).

The saturated polycyclic hydrocarbon compounds of formula (1)–(3) mixtures thereof or mixtures of these hydrocarbon compounds and the saturated polycyclic hydrocarbon compounds of formula (4) may be used as they are or in the form of a mixture with another fluid as a traction drive fluid and have been found to have a high traction coefficient. The saturated polycyclic hydrocarbon compounds of formulae (1)–(4) are inexpensive since they can be produced by subjecting inexpensive starting materials such as cyclopentadiene, methylcyclopentadiene, butadiene and isoprene to Diels-Alder reaction which is thermal reaction.

In the aforesaid synthesis process, the Diels-Alder reaction should be carried out multi-stepwise. The synthesis intermediates of formula (5) and (8) are frequently obtained as by-products of a petrochemical process using cyclopentadiene or butadiene. Therefore, use of such by-products are contributive to the reduction of production cost.

There is a more economically advantageous process of producing mixtures of the saturated polycyclic hydrocarbon compounds of formulae (1)–(3) or (1)–(4), which process is conducted in a single step by subjecting starting materials such as butadiene and/or isoprene and cyclopentadiene and/or methylcyclopentadiene, to Diels-Alder reaction and hydrogenating the resulting reaction product. In this single step process, there may be used dicylopentadiene-, methyidicyclopentadiene- and methylcyclopentadiene-dimers which produce cyclopentadiene and/or methylcyclopentadiene by thermal decomposition under the reaction conditions.

When the mixtures of the saturated polycyclic hydrocarbon compounds are obtained in the above single step process, the resulting mixture preferably contains 5–90 mass percent of the compound of formula (1), 5–90 mass percent of the compound of formula (2), 5–90 mass percent of the compound of formula (3) and 0–85 mass percent of the compound of formula (4), based on the total mass of the mixture. The mixture of the saturated polycyclic hydrocarbon compounds more preferably contains 10–80 mass percent of the compound of formula (1), 10–80 mass percent of the compound of formula (2), 10–80 mass percent of the compound of formula (3) and 0–70 mass percent of the compound of formula (4), based on the total mass of the mixture.

The content of Component (A) in the inventive traction drive fluid is arbitrary, but may be within the range of 5–100 mass percent, preferably 10–100 mass percent, based on the total mass of the fluid, in view of an excellent traction coefficient and flowability at low temperatures.

The content of Component (B) in the inventive traction drive fluid is also arbitrary, but may be within the range of 0–95 mass percent, preferably 10–90 mass percent, based on the total mass of the fluid. The blend ratio of Component (A) to Component (B) is 1:99–100:0, preferably 5:95–100:0 by weight.

The above described Component (A) or the mixture of Components (A) and (B) may be used for the traction drive fluid of the invention as they are, but preferably contains at least one member selected from a mineral oil and a synthesized oil having a molecular weight of 150–800, preferably 150–500, in order to enhance flowability at low temperatures and viscosity-temperature characteristics.

Specific examples of eligible mineral oil for the purpose of the invention are n-paraffins such as paraffinic- and naphthenic-mineral oils which are produced by subjecting lubricant fractions derived from atmospheric- or vacuum distillation of crude oil to refining processes such as solvent deasphalting, solvent extraction, hydrocracking, solvent dewaxing, catalytic dewaxing, hydrotreating, sulfuric acid washing, clay treatment and combinations thereof. The mineral oils are restricted in terms of kinematic viscosity but have a kinematic viscosity at 100° C. of 1–10 $mm^2/s$, preferably 2–8 $mm^2/s$.

The synthetic oils to be used for the inventive traction drive fluid necessarily have a molecular weight of 150–800, preferably 150–500. Synthetic oils having less than 150 molecular weights would be increased in evaporation loss, while those having more than 800 molecular weight would cause the deterioration of flowability at low temperatures of the resulting fluid.

Eligible synthetic oils may be poly-α-olefins such as 1-octene oligomer, 1-decene olygomer and ethylene-propylene oligomer and hydrogenated products thereof, isobutene oligomer and hydrogenated products thereof, isoparaffin, alkylbenzene, alkylnaphthalene, diesters such as ditridecyl glutarate, di2-ethyl adipate, diisodecyl adipate, ditridecyl adipate and di2-ethylhexyl sebacate, polyol esters such as trimethylolpropane caprylate, trimethylolpropane pelargonate, pentaerythritol-2-ethyl hexanoate and pentaerythritol pelargonate, polyoxyalkylene glycol, dialkyldiphenyl ether and polyphenylether.

Among these synthetic oils, particularly preferred are isobutene oligomers or hydrogenated products thereof and synthetic oils represented by the following formulae (11) through (16) given below because these oils are highly contributive to the production of a traction drive fluid which is superior in total performances such as a high traction coefficient and an excellent flowability at low temperatures:

(11)

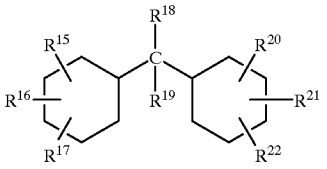

wherein $R^{15}$ through $R^{22}$ are each independently hydrogen or a $C_1$–$C_8$ alkyl group which may have a naphthenic ring, preferably a $C_1$–$C_4$ alkyl group;

(12)

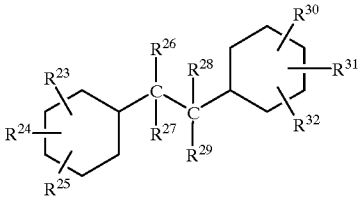

wherein $R^{23}$ through $R^{32}$ are each independently hydrogen or a $C_1$–$C_8$ alkyl group which may have a naphthenic ring, preferably a $C_1$–$C_4$ alkyl group;

(13)

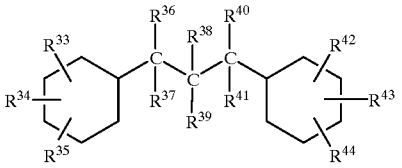

wherein $R^{33}$ through $R^{44}$ are each independently hydrogen or a $C_1$–$C_8$ alkyl group which may have a naphthenic ring, preferably a $C_1$–$C_4$ alkyl group;

(14)

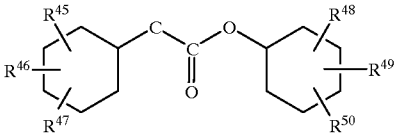

wherein $R^{45}$ through $R^{50}$ are each independently hydrogen or a $C_1$–$C_8$ alkyl group which may have a naphthenic ring, preferably a $C_1$–$C_4$ alkyl group;

(15)

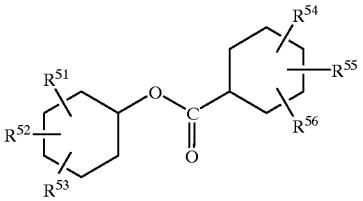

wherein $R^{45}$ through $R^{56}$ are each independently hydrogen or a $C_1$–$C_8$ alkyl group which may have a naphthenic ring, preferably a $C_1$–$C_4$ alkyl group; and (16)

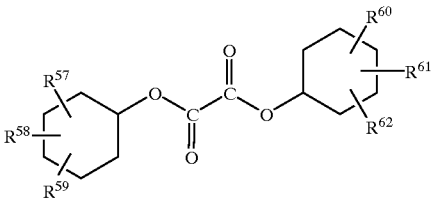

wherein $R^{57}$ through $R^{62}$ are each independently hydrogen or a $C_1$–$C_8$ alkyl group which may have a naphthenic ring, preferably a $C_1$–$C_4$ alkyl group.

Preferred alkyl groups each for $R^{15}$ through $R^{62}$ are a straight or branched alkyl group such as methyl, ethyl, butyl, pentyl, hexyl, heptyl and octyl and an (alkyl)cyclohexylalkyl group of which alkyl group or groups may be straight or branched and of which cyclohexyl group may possess an alkyl substituent at any position, such as cyclopentylmethyl, cyclopentylethyl, cyclopentyl propyl, methyl cyclopentyl methyl, ethylcyclopentyl methyl, dimethylcyclopentylmethyl, methylcyclopentylethyl, cyclohexylmethyl, cyclohexylethyl, methylcyclohexylmethyl and cycloheptylmethyl groups, among which $C_1$–$C_4$ alkyl groups are particularly preferred.

The synthetic oils represented by formulae (11) through (16) are described in detail in the specification of Japanese Laid-Open Patent Publications Nos. 10-96504, 10-96505, 10-112711,10-112712 and 10-112713 which had been filed by the applicant of this application.

The content of Component (C) in the inventive traction drive fluid is arbitrary, but is preferably within the range of 1–99 mass percent, more preferably 5–95 mass percent, based on the total mass of the fluid because the effect of improving flowability at low temperature and viscosity-temperature characteristics can be attained. The ratio of Component (C) to Component (A) is within the range of 1:99–99:1, preferably 5:95–95:5 by weight because the effect of improving flowability at low temperatures and viscosity-temperature characteristics can be enhanced.

The traction drive fluid according to the present invention preferably contains a viscosity index improver hereinafter referred to as Component (D).

Eligible viscosity index improvers for the inventive traction drive fluid are non-dispersion-type viscosity index improvers and/or dispersion-type viscosity index improvers.

The non-dispersion type viscosity index improvers may be copolymers of one or more than two monomers (D-1) selected from the group consisting of compounds represented by the following formulae (17)

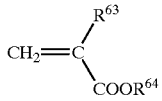

wherein $R^{63}$ is hydrogen or a methyl group and $R^{64}$ is a $C_1$–$C_{18}$ alkyl group;

(18)

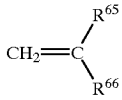

wherein $R^{65}$ is hydrogen or a methyl group and $R^{66}$ is a $C_1$–$C_{12}$ hydrocarbon group; and (19)

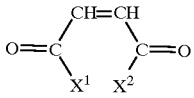

wherein $X^1$ and $X^2$ are each independently hydrogen, a $C_1$–$C_1$ alkyl alcohol residue (—$OR^{67}$ wherein $R^{67}$ is a $C_1$–$C_{18}$ alkyl group) or a $C_1$–$C_{18}$ alkylmonoalkylamine residue (—$NHR^{68}$ wherein $R^{68}$ is a $C_1$–$C_{18}$ alkyl group), and hydrogenated products of the copolymers.

Preferred alkyl groups having 1–18 carbon atoms for $R^{64}$ are methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups, all of which may be straight or branched.

Preferred hydrocarbon groups for $R^{66}$ are a straight or branched alkyl group such as methyl, ethyl, propyl, butyl, pentyl, hexyl, heptyl, octyl, nonyl, decyl, undecyl and dodecyl groups; a straight or branched alkenyl group, the position of which double bond is optional, such as butenyl, pentenyl, hexenyl, heptenyl, octenyl, nonenyl, decenyl, undecenyl and dodecenyl groups; a $C_5$–$C_7$ cycloalkyl group such as cyclopentyl, cyclohexyl and cyclobutyl groups; a $C_6$–Cl, alkylcycloalkyl group, of which cycloalkyl group may possess an alkyl substituent at any position, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; an aryl group such as phenyl and naphtyl groups; a $C_7$–$C_{12}$ alkylaryl group of which alkyl group may be straight or branched and of which aryl group may possess an alkyl substituent at any position, such as tolyl, xylyl, ethylphenyl, propylphenyl, butylphenyl, pentylphenyl and hexylphenyl groups; a $C_7$–$C_{12}$ phenylalkyl group, of which alkyl group may be straight or branched, such as benzyl, phenylethyl, phenylpropyl, phenylbutyl, phenylpentyl and phenylhexyl groups.

The dispersion-type viscosity index improvers may be copolymers of more than two monomers selected from the compounds of formula (18) or hydrogenated products thereof into which an oxygen-containing group is introduced, or copolymers of one or more than two monomers selected from compounds of formulae (17)–(19) and one or more than two monomer (D-2) selected from the compounds of formulae (20) and (21) and hydrogenated products of the copolymers:

(20)

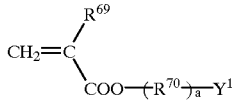

wherein $R^{69}$ is hydrogen or a methyl group, $R^{70}$ is a $C_2$–$C_1B$ alkylene group, $Y^1$ is an amine residue having one or two nitrogen atom and 0–2 oxygen atoms or a heterocyclic residue and a is an integer of 0 or 1;

(21)

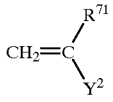

wherein $R^{71}$ is hydrogen or a methyl group and $Y^2$ is an amine residue having one or two nitrogen atom and 0–2 oxygen atoms or a heterocyclic residue.

Specific examples of alkylene group for $R^{70}$ are ethylene, propylene, butylene, pentylene, hexylene, heptylene, octylene, ronilene, decylene, undecylene, dodecylene, tridecylene, tetradecylene, pentadecylene, hexadecylene, heptadecylene and octadecylene groups, all of which may be straight or branched.

Specific examples of the groups for each $Y^1$ and $Y^2$ are dimethylamino, diethylamino, dipropylamino, dibutylamino, anilino, toluidino, xylidino, acetylamino, benzoilamino, morpholino, pyrolyl, pyrolino, pyridyl, methylpyridyl, pyrrolidinyl, piperidinyl, quinonyl, pyrrolidonyl, pyrrolidono, imidazolino and pyrazino groups.

Preferred monomers for Component (D-1) are a $C_1$–$C_{18}$ alkylacrylate, a $C_1$–$C_{18}$ alkylmethacrylate, a $C_2$–$C_{20}$ olefin, styrene, methylstyrene, maleic anhydride ester, maleic anhydride amide and mixtures thereof.

Preferred monomers for Component (D-2) are dimethylaminomethylmethacrylate, diethylaminomethylmethacrylate, dimethylaminoethylmethacrylate, diethylaminoethylmethacrylate, 2-methyl-5-vinylpyridine, morpholinomethylmethacrylate, morpholinoethylmethacrylate, N-vinylpyrrolidone and mixtures thereof.

The mole ratio of the monomers of Components (D-1) and (D-2) upon copolymerization thereof is generally within the range of 80:20–95:5. Any suitable method may be employed for the copolymerizatio and thus the above-described copolymers may be produced by radical-solution polymerization of Components (D-1) and (D-2) in the presence of a polymerization initiator such as benzoyl peroxide.

Specific examples of the viscosity index improver are non-dispersion type- and dispersion type-polymethacrylates, non-dispersion type- and dispersion type-ethylene-α-olefin coplymers and hydrogenated products thereof, polyisobutylenes and hydrogenated products thereof, styrene-diene hydrogenated copolymers, styrene-maleic anhydride ester copolymers and polyalkylstyrene.

It is made possible by blending one or more member selected from these viscosity index improvers with the inventive traction drive fluid to enhance viscosity at elevated temperatures particularly needed by a traction drive fluid for an automobile and improve the balance between the viscosity and flowability at low temperatures.

The viscosity index improver is usually used together with the solvent for the synthesis thereof. In the present invention, such a solvent is preferably selected from the saturated polycyclic hydrocarbon compounds of the above formulae (1) through (4), isobutene oligomers and hydrogenated products thereof and the compounds of the above formulae (11) through (16).

The molecular weight of the viscosity index improver should be selected in view of shear stability. Specifically, the dispersion type- and non-dispersion type-polymethacrylates may be 5,000–150,000, preferably 5,000–35,000 in number-average molecular weight, while polyisobutylenes and hydrogenated products thereof should be 800–5,000, preferably 2,000–4,000. The polyisobutylene and hydrogenated products thereof less than 800 in number-average molecular weight would reduce the thickening characteristics and traction coefficient of the resulting traction drive fluid, while those in excess of 5,000 would deteriorate the shear stability and flowability at low temperatures of the resulting traction drive fluid.

Among these viscosity index improvers, the ethylene-α-olefin copolymers having a number-average molecular weight of over 800 and less than 150,000, preferably 3,000–20,000 or hydrogenated products thereof are particularly preferred because they are contributive to provide a traction drive fluid excelled in total performances such as enhanced traction coefficient and excellent flowability at low temperatures and viscosity at elevated temperatures.

The ethylene-α-olefin copolymers and hydrogenated products thereof having a number-average molecular weight of less than 800 are not preferred because the resulting traction drive would be reduced in thickening characteristics and traction coefficient, while those having a number-average molecular weight of greater than 150,000 are also not preferred because the resulting traction drive fluid would be deteriorated in the shear stability.

Although not restricted, an ethylene component may be contained in the ethylene-α-olefin copolymers or hydrogenated products thereof in an amount of preferably 30–80 mol percent, more preferably 50–80 mol percent. Eligible α-olefins are propylene and 1-butene, the former being more preferred.

Although not restricted, the viscosity index improver may be added to the inventive traction drive fluid in an amount of 0.1–20 mass percent, preferably 0.1–10 mass percent, based on the total mass of the traction drive fluid. The amount in excess of 20 mass percent would reduce the traction coefficient, while the amount less than 0.1 mass percent would fail to attain a sufficient effect.

The traction drive fluid of the present invention preferably contains an ashless dispersant (Component (E)) and a phosphorus-containing additive (Component (F)).

The traction drive fluid of the invention can be imparted with anti-abrasion characteristics, oxidation stability and detergency which are required for a hydraulic pressure controlling mechanism by adding Components (E) and (F).

Components (E) may be a nitrogen-containing compound, derivatives thereof or a modified product of alkenyl succinimide each having at least one alkyl or alkenyl group having 40–400 carbon atoms in the molecules. One or more of these compounds may be added to the inventive traction drive fluid.

The alkyl and alkenyl groups may be straight or branched and specifically are branched alkyl and alkenyl groups derived from oligomers of olefins such as propylene, 1-butene and isobutylene or cooligomers of ethylene and propylene.

The carbon number of the alkyl or alkenyl group is within the range of 40–400, preferably 60–350. Alkyl or alkenyl groups of less than 40 carbon atoms would cause the compound to be poor in solubility to the lubricant base oil, while alkyl or alkenyl groups of more than 400 carbon atoms would deteriorate the flowability of the resulting traction drive fluid.

The nitrogen content of the nitrogen-containing compound exemplified as one example of Component (E) is arbitrary, but may be generally within the range of 0.01–10 mass percent, preferably 0.1–10 mass percent in view of abrasion resistance characteristics, oxidation stability and fiction characteristics.

Specific examples of Component (E) are one or more than two compound selected from:

(E-1) succinimide having in its molecules at least one alkyl or alkenyl group of 40–400 carbon atoms, or derivatives thereof;

(E-2) benzyl amine having in its molecules at least one alkyl or alkenyl group of 40–400 carbon atoms or derivatives thereof; and (E-3) polyamine having in its molecules at least one alkyl or alkenyl group of 40– 400 carbon atoms or derivatives thereof.

Specific examples of Component (E-1) are compounds represented by the formulae (22)

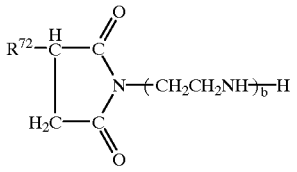

wherein $R^{72}$ is an alkyl or alkenyl group having 40–400, preferably 60–350 carbon atoms and b is an integer of 1–5, preferably 2–4; and (23)

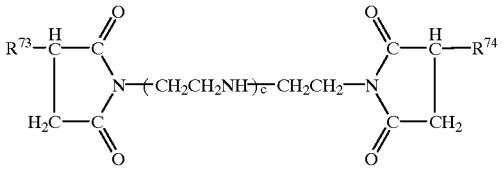

wherein $R^{72}$ and $R^{73}$ are each independently an alkyl or alkenyl group having 40–400, preferably 60–350 carbon atoms and c is an integer of 0–4, preferably 1–3.

The succinimide (E-1) can be classified into mono type succinimide in which succinic anhydride is added to one end of polyamine, as represented by formula (22) and bis-type succinimide in which succinic anhydrides are added to both ends of polyamine as represented by formula (23). Both types of succinimides or mixtures thereof are eligible as Component (E-1).

Specific examples of benzyl amine (E-2) are compounds represented by the formula (24)

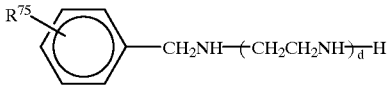

wherein $R^{75}$ is an alkyl or alkenyl group having 40–400, preferably 60–350 carbon atoms and d is an integer of 1–5, preferably 2–4.

Although not restricted, the benzyl amine may be produced by reacting polyolefins such as propylene oligomer, polybutene and ethylene-α-copolymer with phenol to obtain alkylphenol, followed by the Mannich reaction thereof with formaldehyde and polyamine such as diethyltriamine, triethylenetetraamine, tetraethylenepentamine and pentaethylenehexamine.

Specific examples of polyamines (E-3) are compounds represented by the formula (25)

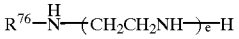

wherein $R^{76}$ is an alkyl or alkenyl group having 40–400, preferably 60–350 carbon atoms and e is an integer of 1–5, preferably 2–4.

Although not restricted, the polyamines may be produced by chloridizing polyolefins such as propylene oligomer, polybutene and ethylene-α-copolymer, followed by reaction of chloridized polyolefins with ammonia and polyamine such as diethyltriamine, triethylenetetraamine, tetraethylenepentamine and pentaethylenehexamine.

The nitrogen-containing compound derivatives as exemplified for Component (E-1) may be (i) an acid-modified compound obtained by allowing the above-described nitrogen-containing compound to react with monocarboxylic acid (aliphatic acid) having 2–30 carbon atoms or polycarboxylic acid having 2–30 carbon atoms such as oxalic acid, phthalic acid, trimellitic acid and pyromellitic acid to neutralizing the whole or part of the remaining amino and/or imino groups; (ii) a boron-modified compound obtained by allowing the above-described nitrogen-containing compound to react with boric acid to neutralizing the whole or part of the remaining amino and/or imino groups; (iii) a sulfur-modified compound obtained by allowing the above-described nitrogen-containing compound to react with sulfur; and (iv) a compound obtained by subjecting the above-described nitrogen containing compound to more than two of the above modifications.

Although not restricted, the content of Component (E) in the inventive traction drive fluid is generally within the range of 0.01–10.0 mass percent, preferably 0.1–7.0 mass percent. Contents less than 0.01 mass percent would be less effective in detergency, while contents greater than 10.0 mass percent would deteriorate extremely the flowability at low temperatures of the resulting traction drive fluid.

Component (F) may be alkyldithio zinc phosphate,, phosphoric acid, phosphorous acid, monophosphate, diphosphate, triphosphate, monophosphites, diphosphites, triphosphites, and salts of phosphites and amines or alkanol amines. Among these components except the phosphoric acid and phosphorus acid, they are generally compounds having a $C_2$–$C_{20}$, preferably $C_3$–$C_{20}$ hydrocarbon group.

Preferred $C_2$–$C_{30}$ hydrocarbon groups are a straight or branched alkyl groups such as ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups; a straight or branched alkenyl group, the position of which double bond is optional, such as butenyl, pentenyl, hexenyl, heptenyl, octenyl, nonenyl, decenyl, undecenyl and dodecenyl, tridecenyl, tetradecenyl, pentadecenyl, hexadecenyl, heptadecenyl and octadecenyl groups; a $C_1$–$C_7$ cycloalkyl group such as cyclopentyl, cyclohexyl, cycloheptyl groups; a $C_6$–$C_{11}$ alkylcycloalkyl group, of which cycloalkyl group may possess an alkyl substituent at any position, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; an aryl group such as phenyl and naphtyl groups; a $C_7$–$C_{18}$ alkylaryl group of which alkyl group may be straight or branched and of which aryl group may possess an alkyl substituent at any position, such as tolyl, xylyl, ethylphenyl, propylphenyl, butylphenyl, pentylphenyl, hexylphenyl, heptyl phenyl, octylphenyl, nonylphenyl, decylphenyl, undecylphenyl and dodecylphenyl groups; a $C_7$–$C_{12}$ arylalkyl group, of which alkyl group may be straight or branched, such as benzyl, phenylethyl, phenylpropyl, phenylbutyl, phenylpentyl and phenyl hexyl groups.

Preferred compounds for Component (F) are phosphoric acid; phosphorus acid; alkyl zinc dithiophosphate, of which alkyl group may be straight or branched, such as dipropyl zinc dithiophosphate, dibutyl zinc dithiophosphate, dipentyl zinc dithiophospahte, dihexyl zinc dithiophospahte, diheptyl zinc dithiophospahte and dioctyl zinc dithiophospahte; monoalkyl phosphate, of which alkyl group may be straight or branched, such as monopropyl phosphate, monobutyl phosphate, monopentyl phosphate, monohexyl phosphate, monoheptyl phospahte and monooctyl phosphate; mono (alkyl)aryl phosphate such as monophenyl phospahte and monocresyl phosphate; dialkyl phosphate, of which alkyl group may be straight or branched, such as dipropyl phosphate, dibutyl phosphate, dipentyl phospahte, dihexyl phosphate, diheptyl phosphate and dioctyl phospahte; di(alkyl)aryl phosphate such as diphenyl phosphate and dicresyl phospahte; trialkyl phosphate, of which alkyl group may be straight or branched, such as tripropyl phosphate, tributyl phosphate, tripentyl phosphate, trihexyl phosphate, triheptyl phosphate and trioctyl phosphate; tri(alkyl)aryl phosphate such as triphenyl phosphate and tricresyl phosphate; monoalkyl phosphite, of which alkyl group may be straight or branched, such as monopropyl phosphite, monobutyl phosphite, monopentyl phosphite, monohexyl phosphite, monoheptyl phosphite and monooctyl phosphite; mono(alkyl)aryl phosphite such as monophenyl phosphite and monocresyl phosphite; dialkyl phosphite, of which alkyl group may be straight or branched, such as dipropyl phosphite, dibutyl phosphite, dipentyl phosphite, dihexyl phosphite, diheptyl phosphite and dioctyl phosphite; di(alkyl)aryl phosphite such as diphenyl phosphite and dicresyl phosphite; trialkyl phosphite, of which alkyl group may be straight or branched, such as tripropyl phosphite, tributyl phosphite, tripentyl phosphite, trihexyl phosphite, triheptyl phosphite and trioctyl phosphite; tri(alkyl)aryl phosphite, of which alkyl group may be straight or branched, such as triphenyl phosphite and tricresyl phosphite; and mixtures thereof.

Specific examples of the salts of phosphites are those obtained by allowing a monophosphate, diphospahte, monophosphite or diphosphite to react with a nitrogen-containing compound such as ammonia or an amine compound having in its molecule only a $C_1$–$C_8$ hydrocarbon group or hydroxyl-containing hydrocarbon group so as to neutralize the whole or part of the remaining acid hydrogen.

Specific examples of such nitrogen-containing compounds are ammonium; alkylamine, of which alkyl group may be straight or branched, such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; an alkanolamine, of which alkanol group may be straight or branched, such as monomethanolamine, monoethanolamine, monopropanolamine, monobutanolamine, monopentanolamine, monohexanolamine, monoheptanolamine, monooctanolamine, mononononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine; and mixtures thereof.

Component (F) may be used singly or in combination.

Phosphorus compounds (referred hereinbelow to as Component (G-2)) having its molecules at least one alkyl or alkenyl group having 6–30 carbon atoms but no hydrocarbon groups of more than 31 carbon atoms and derivatives thereof may be used as Component (F) such that the inventive traction drive fluid can be imparted not only with the aforesaid anti-abrasion characteristics but also with optimized friction characteristics for a wet clutch.

Although not restricted, the content of Component (F) in the inventive traction drive fluid may be in the range of 0.005–0.2 mass percent on an elementary basis, based on the total mass of the fluid. Contents less than 0.005 mass percent would be less effective in anti-abrasion characteristics, while contents greater than 0.5 mass percent would deteriorate the oxidation stability of the resulting fluid.

The traction drive fluid of the present invention preferably contains a friction modifier (Component (G)).

Component (G) is a compound having its molecules at least one alkyl or alkenyl group having 6–30 carbon atoms but no hydrocarbon groups of more than 31 carbon atoms. Component (G) is contributive to the production of a traction drive fluid having optimized friction characteristics.

The alkyl or alkenyl groups of Component (G) may be straight or branched but preferred are compounds having these groups of 6–30, preferably 9–24 carbon atoms. Departures from the range of the specified carbon number would cause the deterioration of the friction characteristics of a wet-type clutch.

Specific examples of the alkyl or alkenyl group are a straight or branched alkyl group such as hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl groups; and a straight or branched alkenyl group, the position of which double bond is optional, such as hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl and triacontenyl groups.

Friction modifiers containing a hydrocarbon group of more than 31 carbon atoms are not preferred because of deteriorating the friction characteristics of a wet clutch.

Specific examples of Component (G) are one or more compound selected from:

(G-1) an amine compound having at least one alkyl or alkenyl group of 6–30 carbon atoms and having no hydrocarbon groups of more than 31 carbon atoms, or derivatives thereof;

(G-2) a phosphorus compound having at least one alkyl or alkenyl group of 6–30 carbon atoms and having no hydrocarbon groups of more than 31 carbon atoms, or derivatives thereof; and (G-3) an amide or metallic salt of a fatty acid having at least one alkyl or alkenyl group of 6–30 carbon atoms and having no hydrocarbon groups of more than 31 carbon atoms, or derivatives thereof.

Specific examples of the amine compound (G-1) are aliphatic monoamines of the formula (26)

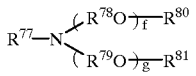

or alkyleneoxide adducts thereof;
aliphatic polyamines of the formula (27)

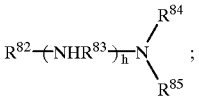

and imidazolyne compounds of the formula (28)

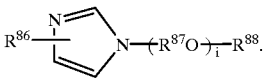

In formula (26), $R^{77}$ is a $C_6$–$C_{30}$, preferably $C_9$–$C_{24}$ alkyl or alkenyl group, $R^{78}$ and $R^{79}$ are each independently ethylene or propylene group, $R^{80}$ and $R^{91}$ are each independently hydrogen or a $C_1$–$C_{30}$ hydrocarbon group, f and g are each independently an integer of 0–10, preferably 0–6 and f+g=0–10, preferably 0–6.

In formula (27), $R^{82}$ is a $C_6$–$C_{30}$, preferably $C_9$–$C_{24}$ alkyl or alkenyl group, $R^{83}$ is an ethylene or propylene group, $R^{84}$ and $R^{85}$ are each independently hydrogen or a $C_1$–$C_{30}$ hydrocarbon group and h is an integer of 1–5, preferably 1–4.

In formula (28), $R^{86}$ is a $C_6$–$C_{30}$, preferably $C_9$–$C_{24}$ alkyl or alkenyl group, $R^{87}$ is ethylene or propylene group, $R^{88}$ is hydrogen or a $C_1$–$C_{30}$ hydrocarbon group and i is an integer of 0–10, preferably 0–6.

The alkyl and alkenyl groups for $R^{77}$, $R^{82}$ and $R^{86}$ may be straight or branched but should have 6–30, preferably 9–24 carbon atoms. Departures from the specified range of carbon atoms would result cause a deterioration in the friction characteristics of a wet-type clutch.

Specific examples of the alkyl and alkenyl groups for $R^{77}$, $R^{82}$ and $R^{86}$ are the above-mentioned various alkyl and alkenyl groups among which particularly preferred are $C_{12}$–$C_{18}$ straight alkyl and alkenyl groups such as laulyl, myristyl, palmityl, stearyl and oleyl groups.

Specific examples for $R^{80}$, $R^{81}$, $R^{84}$, $R^{85}$ and $R^{88}$ are hydrogen and a straight or branched alkyl group, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl groups; a straight or branched alkenyl group, the position of which double bond is optional, such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl and triacontenyl groups; a $C_5$–$C_7$ cycloalkyl group such as cyclopentyl, cyclohexyl and cycloheptyl groups; a $C_6$–$C_{11}$ alkylcycloalkyl group, of which cycloalkyl group may possess alkyl substituent at any position, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; an aryl group such as phenyl and naphtyl groups; a $C_7$–$C_{18}$ alkylaryl group, of which alkyl group may be straight or branched and of which aryl group may possess alkyl substituent at any position, such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl groups; and a $C_7$–$C_{12}$ arylalkyl group of which alkyl group may be straight or branched, such as benzyl, phenylethyl, phenylpropyl, phenylbutyl, phenylpentyl and phenylhexyl groups.

In view of capability of imparting good friction characteristics to a wet-type clutch, preferred aliphatic monoamines represented by formula (26) or alkyleneoxide adducts thereof are aliphatic monoamines of formula (26) wherein $R^{80}$ and $R^{81}$ are each independently hydrogen or a $C_1$–$C_6$ alkyl group and f=g=0 and alkyleneoxide adducts of aliphatic monoamine of formula (26) wherein $R^{80}$ and $R^{81}$ are each independently hydrogen and f and g each are an integer of 0–6 and f+g=1–6.

In view of capability of imparting good friction characteristics to a wet-type clutch, preferred aliphatic polyamines of formula (27) are those represented by formula (27) wherein $R^{84}$ and $R^{85}$ are each independently hydrogen or a $C_1$–$C_6$ alkyl group.

In view of capability of imparting good friction characteristics to a wet-type clutch, preferred imidazoline compounds of formula (28) are those represented by formula (28) wherein $R^{88}$ is hydrogen or a $C_1$–$C_6$ alkyl group.

The derivatives of the amine compound also referred to as (G-1) may be (i) an acid-modified compound obtained by allowing the above-described amine compound of formula (26), (27) or (28) to react with monocarboxylic acid (aliphatic acid) having 2–30 carbon atoms or polycarboxylic acid having 2–30 carbon atoms such as oxalic acid, phthalic acid, trimellitic acid and pyromellitic acid to neutralizing the whole or part of the remaining amino and/or imino groups; (ii) a boron-modified compound obtained by allowing the amine compound of formula (26), (27) or (28) to react with boric acid to neutralizing the whole or part of the remaining amino and/or imino groups; (iii) a salt of phosphate obtained by allowing the amine compound of formula (26), (27) or (28) to react with acid phosphate or acid phosphite each having in its molecules one or two $C_1$–$C_{30}$ hydrocarbon with no hydrocarbons of more than 31 carbon atoms and having at least one hydroxyl group to neutralize the whole or part of the remaining amino or imino group; (iv) an alkyleneoxide adduct of an amine compound obtained by allowing the amine compound of formula (27) or (28) to react with an alkyleneoxide such as ethylene oxide and propylene oxide; and (v) a modified product of an amine compound obtained by subjecting an amine compound to more than two of the aforesaid modifications.

Specific examples of the amine compound (G-1) and derivatives thereof are amine compounds such as lauryl amine, lauryl diethylamine, lauryl diethanolamine, dodecyldipropanolamine, palmitylamine, stearylamine, stearyltetraethylenepentamine, oleylamine, oleylpropylenediamine, oleyldiethanolamine, N-hydroxyethyloleylimidazolyne; alkyleneoxide adducts these amine compounds; salts of these amine compounds and acid phosphate (for example di-2-ethylhexylphosphate) or acid phosphite (for example 2-ethylhexylphosphite); a boric acid-modified product of these amine compounds, alkyleneoxide adducts of these amine compounds or phosphites of these amine compounds; and mixtures thereof.

The phosphorus compound (G-2) are phosphates represented by the formula

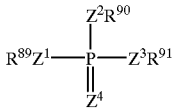

(29)

wherein $R^{89}$ is a $C_6$–$C_{30}$, preferably $C_9$–$C_{24}$ alkyl or alkenyl group, $R^{90}$ and $R^{91}$ are each independently hydrogen or a $C_1$–$C_{30}$ hydrocarbon group and $Z^1$, $Z^2$, $Z^3$ and $Z^4$ are each independently oxygen or sulfur provided that at least one of $Z^1$ through $Z^4$ is oxygen;

and phosphites represented by the formula

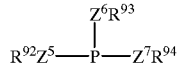

(30)

wherein $R^{92}$ is a $C_6$–$C_{30}$, preferably $C_9$–$C_{24}$ alkyl or alkenyl group, $R^{93}$ and $R^{94}$ are each independently hydrogen or a $C_1$–$C_{30}$ hydrocarbon group and $Z^5$, $Z^6$ and $Z^7$ each are oxygen or sulfur, provided that at least one of $Z^5$ through $Z^7$ is oxygen.

The alkyl or alkenyl group for $R^{89}$ and $R^{92}$ may be straight or branched but should have 6–30, preferably 9–24 carbon atoms.

Departures form the above-specified range of carbon number would cause a deterioration in the friction characteristics of a wet-type clutch.

Specific examples of the alkyl and alkenyl groups are the above-mentioned various alkyl and alkenyl groups among which particularly preferred are $C_{12}$–$C_{18}$ straight alkyl and alkenyl groups such as laulyl, myristyl, palmityl, stearyl and oleyl groups in view of capability of imparting the resulting traction drive fluid with an excellent friction characteristics for a wet-type clutch.

Specific examples of the groups for $R^{90}$, $R^{91}$, $R^{93}$ and $R^{94}$ are hydrogen; a straight or branched alkyl group such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl groups; a straight or branched alkenyl group, the position of which double bond is optional, butenyl, pentenyl, hexenyl, heptenyl, octenyl, nonenyl, decenyl, undecenyl, dodecenyl, tridecenyl, tetradecenyl, pentadecenyl, hexadecenyl, nonadecenyl, eicocenyl, heneicocenyl, dococenyl, tricocenyl, tetracocenyl, pentacocenyl, hexacocenyl, heptacocenyl, octacocenyl, nonacocenyl and triacontenyl groups; a $C_5$–$C_7$ cycloalkyl group such as cyclopentyl, cyclohexyl and cycloheptyl groups; a $C_6$–$C_{11}$ alkylcycloalkyl group, of which cycloalkyl group may possess an alkyl substituent at any position, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; an aryl group such as phenyl and naphtyl groups; a $C_7$–$C_{18}$ alkylaryl group, of which alkyl group may be straight or branched and of which aryl group may possess an alkyl substituent at any position, such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl groups; and a $C_7$–$C_{12}$ arylalkyl group, of which alkyl group may be straight or branched, such as benzyl, phenylethyl, phenylpropyl, phenylbutyl, phenylpentyl and phenylhexyl groups.

In view of capability of imparting the resulting traction drive fluid with excellent friction characteristics for a wet-type clutch, preferred phosphorus compounds (G-2) are acid phosphates represented by formula (29) wherein at least one of $R^{90}$ and $R^{91}$ is hydrogen and acid phosphites represented by formula (30) wherein at least one of $R^{93}$ and $R^{94}$ is hydrogen.

Specific examples of the derivatives of phosphoric compound also referred to as (G-2) are salts obtained by allowing the acid phosphite of formula (29) wherein at least either one of $R^{90}$ and $R^{91}$ is hydrogen or the acid phosphite of formula (30) wherein at least one of $R^{93}$ and $R^{94}$ is hydrogen to react with a nitrogen-containing compound such as ammonia or an amine compound having in its molecules only a $C_1$–$C_8$ hydrocarbon group or hydroxyl-containing group to neutralize the whole or part of the remaining acid hydrogen.

Specific examples of such a nitrogen-containing compound are ammonium; alkylamine, of which alkyl group may be straight or branched, such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methyl butyl amine, ethylbutylamine, propylbutylamine, dibutylamine, dipentylamine, dihexylamine, diheptylamine and dioctylamine; an alkanolamine, of which alkanol group may be straight or branched, such as monomethanolamine, monoethanolamine, monopropanolamine, monobutanolamine, monopentanolamine, monohexanolamine, monoheptanolamine, monooctanolamine, mononononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine; and mixtures thereof.

In view of capability of imparting the resulting traction drive fluid with excellent friction characteristics for a wet-type clutch, particularly preferred phosphorus compounds and derivatives thereof (G-2) are monolauryl phosphate, dilauryl phosphate, monostearyl phosphate, distearyl phosphate, monooleyl phosphate, dioleyl phosphate, monolauryl phosphate, dilauryl phosphite, monostearyl phosphite, distearyl phosphite, monooleyl phosphite, dioleylphosphite, monolauryl thiophosphate, dilauryl thiophosphate, monostearyl thiophosphate, distearyl thiophosphate, monooleyl thiophosphate, dioleyl thiophosphate, monolauryl thiophosphate, dilauryl thiophosphite, monostearyl thiophosphite, distearyl thiophosphite, monooleyl thiophosphite, dioleyl thiophosphite; amine salts (mono2-ethylhexylamine salts) of these phosphate, phosphite, thiophosphate and thiophosphite; and mixtures thereof.

The fatty acid of the fatty amide or fatty metal salt (G-3) may be straight or branched and saturated or unsaturated fatty acid but the alkyl or alkenyl groups thereof should have 6–30, preferably 9–24 carbon atoms. The fatty acid if having the alkyl or alkenyl group of less than 6 carbon atoms or greater than 30 carbon atoms would deteriorate the friction characteristics of the resulting traction drive fluid for a wet-type clutch.

Specific examples of the fatty acid are straight or branched saturated fatty acid such as heptanoic acid, octanonic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, henicosanoic acid, docosanoic acid, tricosanoic acid, tetracosanoic acid, pentacosanoic acid, hexacosanoic acid, heptacosanoic acid, octacosanoic acid, nonacosanoic acid and triacontanoic acid; and straight or branched unsaturated aliphatic acid, the position of which double bond is optional, such as heptanoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, eicosenoic acid, heneicosenoic acid, docosenoic acid, tricosenoic acid, tetracosenoic acid, pentasenoic acid, hexacosenoic acid, heptacosenoic acid, octacosenoic acid, nonacosenoic acid and triacontenoic acid. In view of their superior friction characteristics for a wet-type clutch, particularly preferred fatty acids are straight fatty acids derived from various types of fats and oils such as lauric acid, myristic acid, palmitic acid, stearic acid and oleic acid and mixtures of straight aliphatic acid and branched aliphatic acid obtained by oxo synthesis.

The fatty acid amide referred to as (G-3) may be amide obtained by reacting a nitrogen-containing compound such as ammonia and an amine compound having its molecules a $C_1$–$C_8$ hydrocarbon group or hydrocarbon group having hydroxyl groups with the above-described fatty acid or the acid chloride thereof.

Specific examples of such a nitrogen-containing compound are ammonia; alkylamine, of which alkyl group may be straight or branched, such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; and alkanolamine, of which alkanol group may be straight or branched, such as monomethanolamine, monoethanolamine, monopropanolamine, monobutanolamine, monopentanolamine, monohexanolamine, monoheptanolamine, monooctanolamine, mononononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine.

In view of their superior friction characteristics for a wet-type clutch, specific examples of the fatty acid amide (G-3) are lauric acid amide, lauric acid diethanolamide, lauric monopropanolamide, myristic acid amide, myristic acid diethanolamide, myristic acid monopropanolamide, palmitic acid amide, palmitic acid ethanolamide, palmitic acid monopropanolamide, stearic acid amide, stearic acid diethanolamide, stearic acid monopropanolamide, oleic acid amide, oleic acid diethanolamide, oleic acid monopropanol amide, coconut oil fatty amide, coconut oil fatty acid diethanolamide, coconut oil fatty monopropanolamide, $C_{12}$–$C_{13}$ synthetic mixed fatty amide, $C_{12}$–$C_{13}$ synthetic mixed fatty diethanolamide, $C_{12}$–$C_{13}$ mixed fatty monopropanolamide and mixtures thereof.

The fatty metallic salt also referred to as (G-3) may be exemplified by alkaline earth metals of the above-exemplified fatty acids such as magnesium salt and calcium salt and zinc salt.

In view of their superior friction characteristics for a wet-type clutch, particularly preferred fatty metallic salts (G-3) are calcium laurate, calcium myristate, calcium palmitate, calcium stearate, calcium oleate, coconut oil fatty acid calcium, $C_{12}$–$C_{13}$ synthetic mixed fatty acid calcium, zinc laurate, zinc myristate, zinc palmitate, zinc stearate, zinc oleate, coconut oil fatty zinc, $C_{12}$–$C_{13}$ synthetic mixed fatty zinc and mixtures thereof.

Any one or more members arbitrary selected from the above-described Components (G) may be added to the inventive traction drive fluid in any suitable amount as long as they do not adversely affect the other performances of the resulting fluid such as oxidation stability. In order to enhance the durability of friction characteristics of the fluid, it is necessary to avoid a deterioration in friction characteristics caused by the deterioration of Component (G). The addition of large amounts of Component (G) is effective in enhancing the durability of the friction characteristics. However, too large amounts of Component (G) would lead to a reduction in static friction coefficient which is required to be high so as to maintain coupling of a wet-type clutch. The amount of Component (G) is thus limited to some extent. Therefore, the content of Component (G) is within the range of preferably 0.005–3.0 mass percent, preferably 0.01–2.0 mass percent, based on the total mass of the traction drive fluid.

When there arises a necessity of adding Component (S) in an amount more than such limit so as to improve the durability of friction characteristics, there may be added an additive for enhancing friction coefficient hereinafter referred to as Component (I).

Component (I) may be exemplified by the following compounds:

(I-1) a compound having the same polar groups as those of Component (G) in the same molecule and the lipophilic group which is a hydrocarbon group having less than 100 carbon atoms; and (I-2) a nitrogen-containing compound (succinimide- and succinamide-compounds) or a compound obtained by modifying the nitrogen-containing compound with a boron compound such as boric acid or a sulfur compound.

When Components (G) and (I) are used in combination in the inventive traction drive fluid, the content of Component (I) is within the range of preferably 0.1–10.0 mass percent, more preferably 0.5–3.0 mass percent, based on the total mass of the fluid. Contents less than 0.1 mass percent would be less effective in increasing static friction coefficient, while contents more than 10.0 mass percent cause a deterioration in flowability at low temperatures and oxidation stability.

The inventive traction drive fluid is preferably contains a metallic detergent hereinafter referred to as Component (H). The addition of Component (H) makes it possible to optimize the friction characteristics of a wet-type clutch and restrict a reduction in strength thereof which reduction is caused by pressure being applied repeatedly.

Preferred metallic detergents are basic metallic detergents of 20–450 mgKOH/g, preferably 50–400 mgKOH/g in total base number. The term "total base number" referred herein designates total base number measured by perchloric acid potentiometric titration method in accordance with section 7 of JIS K2501 "Petroleum products and lubricants-Determination of neutralization number".

Metallic detergents if less than 20 mgKOH/g in total base number would be less effective in inhibiting the parts of a wet-type clutch from being reduced in strength due to the repeated compression applied thereto and if exceeding 450 mgKOH/g would be unstable in structure, leading to a deterioration in the storage stability of the resulting composition.

Component (H) may be one or more member selected from the following metal detergents:

(H-1) alkaline earth metal sulfonate of 20–450 mgKOH/g in total base number;

(H-2) alkaline earth metal phenate of 20–450 mgKOH/g in total base number; and (H-3) alkaline earth metal salicylate of 20–450 mgKOH/g in total base number.

Preferred alkaline earth metal sulfonate referred to as Component (H-1) may be alkaline earth metal salts of alkyl aromatic sulfonic acid obtained by sulfonating an alkyl aromatic compound having a molecular weight of 100–1,500, preferably 200–700. Particularly preferred are magnesium sulfonate and/or calcium sulfonate. The alkyl aromatic sulfonic acid may be petroleum sulfonic acid and synthetic sulfonate acids.

The petroleum sulfonic acid may be mahogany acid obtained by sulfonating the alkyl aromatic compound contained in the lubricant fraction of mineral oil or by-produced upon the production of white oil. The synthetic sulfonic acid may be those obtained by sulfonating alkyl benzene having a straight or branched alkyl group, which may be by-produced from a plant for producing alkyl benzene used as material of detergents, or sulfonating dinonyinaphthalene. Although not restricted, there may be used fuming sulfuric acid and sulfuric acid as a sulfonating agent.

The alkaline earth metal phenate referred to as Component (H-2) may be alkaline earth metal salts of alkylphenol having at least one straight or branched alkyl group of 4–30, preferably 6–18 carbon atoms, alkylphenolsulfide obtained by reacting the alkylphenol with elementary sulfur or a product resulting from Mannich reaction of the alkylphenol and formaldehyde. Particularly preferred are magnesium phenate and/or calcium phenate.

The alkaline earth metal salicylate referred to as Component (H-3) may be alkaline earth metal salts of alkyl salicylic acid having at least one straight or branched alkyl group of 4–30, preferably 6–18 carbon atoms. Particularly preferred are magnesium salicylate and/or calcium salicylate.

Components (H-1), (H-2) and (H-3), as long as they are 100–450 mgKOH/g in total base number, may be (i) basic salts obtained by heating a normal alkaline earth metal salt in water containing an excess amount of an alkaline earth metal salt or an alkaline earth metal hydroxide or oxide and (ii) ultrabasic salts obtained by reacting a normal alkaline earth metal salt with an alkaline earth metal oxide or hydroxide in the presence of carbon dioxide. The above-mentioned normal salt may be produced directly by reacting a compound such as alkyl aromatic sulfonic acid, alkylphenol, alkylphenol sulfide, the Mannich reaction product thereof and alkyl salicylic acid with an alkaline earth metal oxide or hydroxide, or produced indirectly by reacting the compound with an alkali metal oxide or hydroxide so as to obtain an alkali metal salt of the compound, followed by converting the alkali metal salt into an alkaline earth metal salt. The alkaline earth metal oxide or hydroxide may be those of magnesium or calcium.

These reactions may be carried out in a solvent, for example, an aliphatic hydrocarbon solvent such as hexane, an aromatic hydrocarbon solvent such as xylene and a light lubricant base oil. Commercially available metallic detergents are usually diluted with a light lubricant base oil. It is preferred to use metallic detergents containing metal in an amount of 1.0–20 mass percent, preferably 2.0–16 mass percent.

Although not restricted, the content of Component (H) in the inventive traction drive fluid is within the range of 0.01–5.0 mass percent, preferably 0.05–4.0 mass percent, based on the total mass of the fluid. Contents less than 0.05 mass percent would be less effective in inhibiting a wet-type clutch from being reduced in strength due to repeated compression, while contents greater than 5.0 mass percent would reduce the oxidation stability of the resulting composition.

With the above-described Components (E), (F), (G) and (H), the inventive traction drive fluid can be imparted with wear resistance, oxidation stability and detergency needed for a hydraulic controlling mechanism and friction characteristics for a wet-type clutch needed for a friction characteristics controlling mechanism as well as the capability of providing the wet-type clutch with strength against repeatedly applied compression force. For the purpose of further enhancing these capabilities and improving the resistance to corrosiveness of nonferrous metals such as copper materials as well as durability of resins such as nylon, the inventive traction drive fluid may be added with antioxidants, extreme pressure agents, corrosion inhibitors, rubber swelling agents, antifoamers and colorants. These additives may be used singlely or in combination.

Antioxidants may be phenol-based or amine-based compounds such as alkylphenols such as 2-6-di-tert-butyl-4-methylphenol, bisphenols such as methylene-4,4-bisphenol (2,6-di-tert-butyl-4-methylphenol), naphtylamines such as phenyl-α-naphtylamine, dialkyldiphenylamines, zinc dialkyldithiophosphates such as zinc di-2-ethylhexyldithiophosphate, esters of 3,5-di-tert-butyl-4-hydroxyphenyl fatty acid (propionic acid) with a mono- or polyhydric alcohol such as methanol, octadecanol, 1,6 hexanediol, neopentyl glycol, thiodiethylene glycol, triethylene glycol or pentaerythritol.

One or more of these compounds is preferably added in an amount of 0.01–5.0 mass percent.

Extreme pressure additives may be sulfur-containing compounds such as disulfides, olefin sulfides and sulfurized fats and oils. One or more of these compounds is preferably added in an amount of 0.1–5.0 mass percent.

Corrosion inhibitors may be benzotriazoles, tolyltriazoles, thiodiazoles and imidazoles. One or more of these compounds is preferably added in an amount of 0.01–3.0 mass percent.

Antifoamers may be silicones such as dimethylsilicone and fluorosilicone. One or more of these compounds is preferably added in an amount of 0.001–0.05 mass percent.

Colorants may be added in an amount of 0.001–1.0 mass percent.

The invention will be further described by way of the following examples which are provided only for illustrative purposes.

EXAMPLES

The traction drive fluid of the present invention having compositions as indicated in Table 1 was prepared by the following method.

5951 grams (110.0 mols) of butadiene and 4052 grams (61.3 mols) of cyclopentadiene were charged into a reaction vessel and subjected to Diels-Alder reaction at 140° C. for 5 hours. The reaction product was distilled out so as to remove the unreacted materials and dimerized products. After the removal, tirmerized fraction was distilled out and purified thereby obtaining trimerized product.

Powder nickel catalyst N113 manufactured by Nikki Chemical Co., Ltd was added to the trimerized product thus obtained so as to be 2 weight part. The admixture was hydrogenated at a hydrogen pressure of 7.1 MPa and at a reaction temperature of 120° C. for 5.5 hours. The catalyst was then removed by filtration thereby obtaining Fluid 1.

It was observed that Fluid 1 contains the following components α, β, γ and δ.

Component(A)

[Component α]

Hydrogenated product of an adduct derived from 2 mols of butadiene and 1 mol of cyclopentadiene

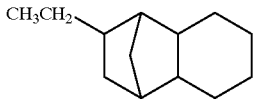

[Component β]

Hydrogenated product of an adduct derived from 1 mol of butadiene and 2 mols of cyclopentadiene

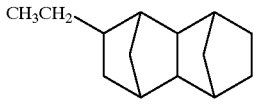

[Component γ]

Hydrogenated product of an adduct derived from 1 mol of butadiene and 2 mols of cyclopentadiene

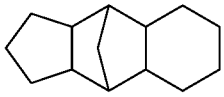

[Component δ]

Hydrogenated product of an adduct derived from 3 mols of cyclopentadiene

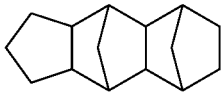

The traction coefficient of each Fluid 1, Fluid 2 produced by the same method as above and isobutene oligomer (Comparative Example 1, number average molecular weight (Mn):350) was measured. The results were shown in Table 1. The traction coefficient was measured by a four-roller traction coefficient test apparatus. The test conditions were as follows:

Peripheral speed 3.14 m/s

Oil temperature: 100° C.

Maximum Hertzian contact pressure: 1.49 GPa

Slip ratio: 2%

TABLE 1

| | Content (mass %) | | | | |
|---|---|---|---|---|---|
| Sample | Component α | Component β | Component γ | Component δ | Traction Coefficient |
| Fluid 1 | 17 | 17 | 32 | 34 | 0.085 |
| Fluid 2 | 26 | 26 | 48 | — | 0.085 |
| Comparative Example 1 | | — | | | 0.061 |

As being apparent form the results of Table 1, the traction drive fluids comprising Component (A) or the mixture of Components (A) and (B) have a high traction coefficient.

Various oils were prepared by mixing the above Fluid 1, isobutene oligomer of Comparative Example 1 (C-1) and 2-methyl-2,4-dicyclohexylpentane (C-2) which has been utilized in the field of industrial machines and is reputed for high traction coefficient, in accordance with the formulations indicated in Table 2. The traction coefficient and low temperature viscosity at 30° C. (Brookfield viscosity) of each oil compositions were measured and the results thereof were shown in Table 2.

TABLE 2

| | Composition (mass %) | | | Traction | Brookfield Viscosity @ −30° C. |
|---|---|---|---|---|---|
| | Fluid 1 | C-1 | C-2 | Coefficient | mPa · s |
| Fluid 3 | 10 | — | 90 | 0.088 | 15,000 |
| Fluid 4 | 50 | — | 50 | 0.087 | 1,600 |
| Fluid 1 | 100 | — | — | 0.085 | 200 |
| Comparative Example 1 | — | 100 | — | 0.061 | 4,500 |
| Comparative Example 2 | — | — | 100 | 0.089 | 30,000 |
| Comparative Example 3 | — | 10 | 90 | 0.085 | 25,000 |
| Comparative Example 4 | — | 50 | 50 | 0.075 | 10,000 |

As being apparent form the results in Table 2, the low temperature viscosity can be significantly improved by mixing the fluid of the present invention with 2-methyl-2,4-dicyclohexylpentane (C-2) which is the existing traction drive fluid, with the traction coefficient being not almost changed.

Fluids 5 through 7 were prepared by mixing Fluid 1 with polymethacrylate (PMA), hydrogenated product of polyisobutylene (PIB) and hydrogenated products of the copolymer of ethylene-α-olefin (OCP) as a viscosity index improver (D). For Fluids 5–7 and Fluid 1 as comparison, the kinematic viscosity at 100° C. and low temperature viscosity at 30° C. (BF viscosity) and the traction coefficient were measured and the results were shown in Table 3.

TABLE 3

| | Composition (mass %) | | | | Kinematic Viscosity @ 100° C. | Brookfield Viscosity @ −30° C. | Traction |
|---|---|---|---|---|---|---|---|
| | | Component D | | | | | |
| | Fluid 1 | PMA | PIB | OCP | $mm^2/s$ | mPa · s | Coefficient |
| Fluid 5 | 91.0 | 9.0 | — | — | 5.0 | 360 | 0.079 |
| Fluid 6 | 91.8 | — | 8.2 | — | 5.0 | 520 | 0.084 |
| Fluid 7 | 96.7 | — | — | 3.3 | 5.0 | 380 | 0.084 |
| Fluid 1 | 100 | — | — | — | 2.1 | 200 | 0.085 |

PMA: Number average molecular weight (Mn) of 18,000
PIB: Number average molecular weight (Mn) of 2,700
OCP: Number average molecular weight (Mn) of 9,900

As being apparent from the results in Table 3, the viscosity at high temperatures can be significantly increased by mixing Component (D) without changing the traction coefficient and low temperature viscosity too much.

Fluids 8–13 were prepared by mixing Fluid 1 with a viscosity index improver (D), an ashless dispersant (E) and a phosphorus-containing additive (F) in accordance with the formulations indicated in Table 4. Fluids 12 and 13 were also prepared for comparison. Each of Fluids 8–13 was evaluated in anti-wear characteristics and oxidation stability. The results were shown in Table 4.

The anti-wear characteristics were evaluated by measuring the total abrasion of a vane and ring which had been subjected to a Vane Pump Test under the conditions of 80° C. and 6.9 MPa in accordance with ASTM D2882 "Indicating the Wear Characteristics of Petroleum and Non-petroleum Hydraulic Fluids in a Constant Volume Vane Pump". The oxidation stability was 4 evaluated by conducting an oxidation test under the conditions of 150° C. and 96 hours in accordance with JIS K 2514 "Lubricating Oil-Determination of oxidation stability".

TABLE 4

| Composition·mass % | | Fluid 8 | Fluid 9 | Fluid 10 | Fluid 11 | Fluid 12 | Fluid 13 |
|---|---|---|---|---|---|---|---|
| Base Oil | Fluid 1 | 97.35 | 97.35 | 93.55 | 96.20 | 93.70 | 96.05 |
| Component D | OCP | — | — | 3.3 | 3.3 | 3.3 | 3.3 |
| Component E | Ashless Dispersant A | 1.5 | — | 1.5 | — | 1.5 | — |
| | Ashless Dispersant B | 1.0 | 2.5 | 1.0 | — | 1.0 | — |
| Component F | Phosphorus-containing Additive A | 0.15 | 0.15 | 0.15 | — | — | 0.15 |
| Other | Oxidation Inhibitor | — | — | 0.5 | 0.5 | 0.5 | 0.5 |
| Vane Pump Test Abrasion Wear, mg | | — | — | 23.5 | — | 852.4 | — |
| Oxidation Stability Test | | | | | | | |
| Total Acid Value Increase, mgKOH/g | | 0.54 | 0.58 | 0.49 | 0.92 | 0.38 | 1.24 |
| Lacquer Rating (deposit) | | None | none | None | Medium | none | dark |
| n-pentane insoluble, mass % | | 0.00 | 0.00 | 0.00 | 0.26 | 0.00 | 0.52 |

OCP: the same as that in Table 3

Ashless Dispersant A: alkenyl succinimide (bis-type, number average molecular weight 5,500)

Ashless Dispersant B: borated succinimide (mono-type, number average molecular weight 4,500)

Phosphorus-containing additive A: dipehnylhydrodiene-phosphite

Oxidation Inhibitor: bisphenol-based

As being apparent from the results of Table 4, traction drive fluids can be imparted with anti-abrasion characteristics and oxidation stability as well as detergency by adding Components (E) and (F).

Fluids 14–19 were prepared by mixing Fluid 1 with a viscosity index improver (D), an ashless dispersant (E), a phosphorus-containing additive (F), a friction modifier (G) and a metallic detergent (H) in accordance with the formulations indicated in Table 5. Fluid 19 was prepared for comparison. The dependence of friction coefficient on slipping speed of each Fluids 14–19 and Fluid 1 was measured using a low velocity slip testing machine in accordance with JASO M349-95 "Automatic transmission fluid-determination of shudder inhibition capability" under the following conditions. The dependence of friction coefficient on slipping speed was expressed by the value of $\mu$ (0.6 cm/s)/$\mu$ (30.0 cm/s). If the value exceeds 1, the dependence was graded as positive gradient. If the value is less than 1, the dependence was graded as negative gradient.

[Low velocity slipping test]

amount: 0.2 L, Oil temperature: 80° C., Surface pressure: 0.98 Mpa

TABLE 5

| Composition · mass % | | Fluid 14 | Fluid 15 | Fluid 16 | Fluid 17 | Fluid 18 | Fluid 1 | Fluid 19 |
|---|---|---|---|---|---|---|---|---|
| Base oil | Fluid 1 | 99.85 | 99.85 | 99.50 | 99.50 | 93.40 | 100 | 94.05 |
| Component D | OCP | — | — | — | — | 3.3 | — | 3.3 |
| Component E | Ashless Dispersant A | — | — | — | — | 1.5 | — | 1.5 |
| | Ashless Dispersant B | — | — | — | — | 1.0 | — | 1.0 |
| Component F | Phosphorus-containing Additive A | '3 | — | — | — | 0.15 | — | 0.15 |
| Component G | Friction Modifier A | 0.15 | — | — | — | 0.15 | — | — |
| | Friction Modifier B | — | 0.15 | — | — | — | — | — |
| Component H | Mg Sulfonate A | — | — | 0.5 | — | — | — | — |
| | Ca Sulfonate B | — | — | — | 0.5 | 0.5 | — | — |
| Low Velocity Slippage Test $\mu$ (0.6 cm/s)/$\mu$ (30.0 cm/s) | | 0.89 Positive Gradient | 0.90 Positive Gradient | 0.93 Positive Gradient | 0.95 Positive Gradient | 0.86 Positive Gradient | 1.73 Negative Gradient | 1.31 Negative Gradient |

OCP: the same as that in Table 3

Ashless Dispersant A: the same dispersant as that in Table 4

Ashless Dispersant A: the same dispersant as that in Table 4

Phosphorus-containing Additive: the additive as that in Table 4

Friction Modifier A: ethoxylated oleylamine

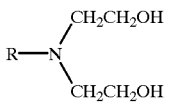

(R:oleyl group)

Friction Modifier B: oleylamine

Mg sulfonate A: petroleum-based, total base number (perchloric method): 300 mgKOH/g Mg content: 6.9 mass percent Ca sulfonate A: petroleum-based, total base number (perchloric method): 300 mgKOH/g Ca content: 12.0 mass percent As being apparent from the results in Table 5, traction drive fluids can be imparted with optimized friction characteristics for a wet clutch such as a variable-speed clutch and a slip-lock-up clutch by adding Component (G).

Fluids 20–22 were prepared by mixing Fluid 1 with a viscosity index improver (D), an ashless dispersant (E), a phosphorus-containing additive (F), a friction modifier (G) and a metallic detergent (H) in accordance with the formulations indicated in Table 6. Fluid 22 was prepared for comparison. A stroke test was conducted for Fluids 20–22 and Fluid 8 under the following conditions using a stroke testing apparatus. The fluids were evaluated in the capability of imparting a wet clutch with strength against repeatedly applied compression by counting the number of stroke cycle taken until the peel-off occurred on the surface of a friction material. The results were shown in Table 6.

[Stroke Test]

Friction material: cellulose material Surface pressure: 9.8 Mpa Oil temperature: 120° C. One cycle: Press 3 sec. Release 7 sec.

TABLE 6

| Composition · mass % | | Fluid 20 | Fluid 21 | Fluid 22 | Fluid 8 |
|---|---|---|---|---|---|
| Base Oil | Fluid 1 | 97.15 | 93.40 | 97.15 | 97.35 |
| Component D | OCP | — | 3.3 | — | — |
| Component E | Ashless Dispersant A | 1.5 | 1.5 | 1.5 | 1.5 |
| | Ashless Dispersant B | 1.0 | 1.0 | 1.0 | 1.0 |
| Component F | Phosphorus-containing Additive A | 0.15 | 0.15 | 0.15 | 0.15 |
| Component G | Friction Modifier A | — | 0.15 | — | — |
| Component H | Ca Sulfonate A | — | 0.5 | — | — |
| | Ca Sulfonate B | 0.2 | — | — | — |
| Ca Sulfonate C | | — | — | 0.2 | — |
| Stroke Test the No. of cycles taken until the occurrence of peel-off | | 14.3 | 13.8 | 6.7 | 5.2 |

OCP: the same as that in Table 3

Ashless Dispersant A: the same dispersant as that in Table 4

Ashless Dispersant A: the same dispersant as that in Table 4

Phosphorus-containing Additive: the additive as that in Table 4

Friction Modifier A: the same agent as that in Table 5

Ca sulfonate A: the same Ca sulfonate in Table 5

Ca sulfonate B: petroleum-based, total base number (perchloric method): 400 mgKOH/g Ca content: 15.5 mass percent Ca sulfonate B: petroleum-based, total base number (perchloric method) 13 mgKOH/g Ca content: 2.5 mass percent As being apparent from the results in Table 6, traction drive fluids can be imparted with optimized friction characteristics for a wet clutch and capability of inhibiting a wet clutch from being reduced in strength, by adding Component (H).

As described above, the traction drive fluid according to the present invention is not only superior in power transmitting capability but also imparted with capabilities required as a fluid for the hydraulic controlling mechanism and the friction characteristics controlling mechanism of the wet clutch of an automobile continuously variable transmission, with which capabilities the conventional traction drive fluids have not been imparted. The inventive traction drive fluid can fully demonstrate performances which are required for an automobile traction drive fluid.

What is claimed is:

1. A traction drive fluid which comprises (A) compounds selected from the group consisting of i.) saturated polycyclic hydrocarbon compounds represented by the formula:

(1)

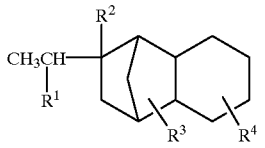

wherein $R^1$ and $R^2$ are each independently a hydrogen or a methyl group, provided that the case where both $R^1$ and $R^2$ are a methyl group at the same time is excluded, and $R^3$ and $R^4$ are each independently a hydrogen or a methyl group;

ii). saturated polycyclic hydrocarbon compounds represented by the formula:

(3)

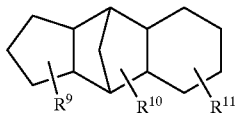

wherein $R^9$, $R^{10}$ and $R^{11}$ are each independently a hydrogen or a methyl group; and iii.) three or more saturated polycyclic hydrocarbon compounds selected from the group consisting of the compounds represented by the formula (1), the compounds represented by the formula (3), and the compounds represented by the formula:

(2)

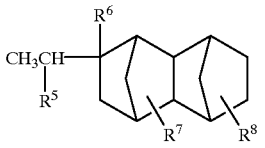

wherein $R^5$ and $R^6$ are each independently a hydrogen or a methyl group, provided that the case where both $R^5$ and $R^6$ are a methyl group at the same time is excluded, $R^7$ and $R^8$ are each independently a hydrogen or a methyl group, and wherein at least one of the compounds represented by the formulae (1) and (3) are in said three or more compounds.

2. The traction drive fluid according to claim 1 which comprises said saturated polycyclic compound of formula (1) in an amount of 5–90 mass percent, said saturated polycyclic compound of formula (2) in an amount of 5– 90 mass percent and said saturated polycyclic compound of formula (3) in an amount of 5–90 mass percent, based on the total mass of the fluid.

3. The traction drive fluid according to claim 1 which further comprises (C) at least one member selected from the group consisting of mineral oils and synthetic oils having a molecular weight of 150–800.

4. The traction drive fluid according to claim 1 which further comprises one or more additive selected from the group consisting of (D) a viscosity index improver, (E) an ashless dispersant, (F) a phosphorus-containing additive, (G) a friction modifier and (H) a metallic detergent having a total base number of 20–450 mgKOH/g.

5. The traction drive fluid according to claim 4 wherein said viscosity index improvers (D) is an ethylene-α-olefin copolymer having a number average molecular weight of 800–150,000 or a hydrogenated products thereof.

6. The traction drive fluid according to claim 4 wherein said friction modifier has in its molecule at least alkyl or alkenyl group having 6–30 carbon atoms but has in its molecule no hydrocarbon group having more than 31 carbon atoms.

7. The traction drive fluid according to claim 3 which further comprises one or more additive selected from the group consisting of (D) a viscosity index improver, (E) an ashless dispersant, (F) a phosphorus-containing additive, (G) a friction modifier and (H) a metallic detergent having a total base number of 20–450 mgKOH/g.

8. The traction drive fluid according to claim 7 wherein said viscosity index improvers (D) is an ethylene-α-olefin copolymer having a number average molecular weight of 800–150,000 or a hydrogenated products thereof.

9. The traction drive fluid according to claim 7 wherein said friction modifier has in its molecule at least alkyl or alkenyl group having 6–30 carbon atoms but has in its molecule no hydrocarbon group having more than 31 carbon atoms.

10. The traction drive fluid according to claim 1 which further comprises (B) one or three or more compounds selected from the group consisting of saturated polycyclic hydrocarbon compounds represented by the formula (4)

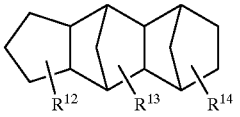

wherein $R^{12}$, $R^{13}$ and $R^{14}$ are each independently a hydrogen or a methyl group.

11. The traction drive fluid according to claim 10 which comprises said saturated polycyclic compound of formula (1) in an amount of 5–90 mass percent, said saturated polycyclic compound of formula (2) in an amount of 5–90 mass percent and said saturated polycyclic compound of formula (3) in an amount of 5–90 mass percent and said saturated polycyclic compound of formula (4) in an amount of 0–85 mass percent, based on the total mass of the fluid.

12. The traction drive fluid according to claim 10 which further comprises (C) at least one member selected from the group consisting of mineral oils and synthetic oils having a molecular weight of 150–800.

13. The traction drive fluid according to claim 10 which further comprises one or more additive selected from the group consisting of (D) a viscosity index improver, (E) an ashless dispersant, (F) a phosphorus-containing additive, (G) a friction modifier and (H) a metallic detergent having a total base number of 20–450 mgKOH/g.

14. The traction drive fluid according to claim 13 wherein said viscosity index improvers (D) is an ethylene-α-olefin copolymer having a number average molecular weight of 800–150,000 or a hydrogenated product thereof.

15. The traction drive fluid according to claim 13 wherein said friction modifier has in its molecule at least alkyl or alkenyl group having 6–30 carbon atoms but has in its molecule no hydrocarbon group having more than 31 carbon atoms.

16. The traction drive fluid according to claim 12 which further comprises one or more additive selected from the group consisting of (D) a viscosity index improver, (E) an ashless dispersant, (F) a phosphorus-containing additive, (G) a friction modifier and (H) a metallic detergent having a total base number of 20–450 mgKOH/g.

17. The traction drive fluid according to claim 16 wherein said viscosity index improvers (D) is an ethylene-α-olefin copolymer having a number average molecular weight of 800–150,000 or a hydrogenated product thereof.

18. The traction drive fluid according to claim 16 wherein said friction modifier has in its molecule at least alkyl or alkenyl group having 6–30 carbon atoms but has in its molecule no hydrocarbon group having more than 31 carbon atoms.

* * * * *